United States Patent [19]

Tomono et al.

[11] Patent Number: 4,803,453

[45] Date of Patent: Feb. 7, 1989

[54] LAMINATED TRANSFORMER

[75] Inventors: Kunisaburo Tomono; Harufumi Mandai; Toshio Kawabata; Yukio Sakamoto; Toyoaki Tsunematsu; Toshimi Kaneko, all of Nagaokakyo, Japan

[73] Assignee: Murata Manufacturing Co., Ltd., Kyoto, Japan

[21] Appl. No.: 96,407

[22] Filed: Sep. 15, 1987

[30] Foreign Application Priority Data

Sep. 22, 1986 [JP] Japan ..... 61-224650

[51] Int. Cl.[4] ..... H01F 27/30

[52] U.S. Cl. ..... 336/183; 336/192; 336/200; 336/232

[58] Field of Search ..... 336/192, 200, 232, 225, 336/180, 182, 183

[56] References Cited

U.S. PATENT DOCUMENTS 3,483,499 12/1969 Lugten ..... 336/200 X
3,833,872 9/1974 Marcus et al. ..... 336/200 X

FOREIGN PATENT DOCUMENTS 140104 8/1983 Japan ..... 336/200
184710 10/1983 Japan ..... 336/200

*Primary Examiner*—Thomas J. Kozma
*Attorney, Agent, or Firm*—Wenderoth, Lind & Ponack

[57] ABSTRACT

A laminated transformer includes a plurality of ferrite sheets having surfaces on which conductor patterns are formed and are laminated and baked to be a sintered body, and a pair of the primary external electrodes and a pair of the secondary external electrodes are provided at end faces of the sintered body. The transformer is used mainly in a high frequency circuit, the conductor patterns formed at the laminated ferrite sheets being used as the primary or the secondary, both ends of the primary conductor patterns being electrically connected to the pair of the primary external electrodes and both ends of the secondary conductor patterns being electrically connected to the pair of the secondary external electrodes, so that the primary and secondary conductor patterns have no coiled construction and no self-distributed capacity, so that the laminated transformer will no induce self-resonance even when used in a high frequency band.

4 Claims, 2 Drawing Sheets

LAMINATED TRANSFORMER

FIELD OF THE INVENTION

The present invention relates to a laminated transformer, and more particularly, to a laminated transformer used mainly in a high frequency circuit.

BACKGROUND OF THE INVENTION

The conventional transformers of a winding type and a lamination type are well-known as parts of an electronic circuit.

The winding type transformer comprises the primary and secondary windings on a ferrite core, which is hard to miniaturize. Since terminal treatment on the lead wire is difficult, the transformer is hard to mass-produce, whereby it is difficult to eliminate lead wires or to be chipped. Moreover, in order to adjust an inductance value, the number of turns of each winding must be changed and must be an integer, whereby it is difficult to obtain a desired inductance value.

On the contrary, the lamination type transformer, which enables miniaturization and chipping, has recently widely been used.

One conventional example of such a lamination type transformer is a laminated transformer 30 (FIG. 5) known as the through-hole system. The laminated transformer 30 comprises a plurality (seven in FIG. 5) of ferrite sheets 31 to 37 laminated in order and baked to be integral, each ferrite sheet including a conductor pattern or a through hole formed as follows. At first, on the surface of the ferrite sheet 31 is formed a J-shaped conductor pattern 31*a* extending at one end to the outer edge of the sheet 31. On the surface of the ferrite sheet 32 is formed a U-shaped conductor pattern 32*a* and at one end thereof is formed a through hole 32*b* perforating the ferrite sheet 32. On the surface of the ferrite sheet 33 is formed a J-shaped conductor pattern 33*a* extending at one end to the outer edge of the sheet 33 and at the other end of the conductor pattern 33*a* is formed a through hole 33*b* perforating the sheet 33.

On the surface of the ferrite sheet 34 is formed a J-shaped conductor pattern 34*a* extending at one end to the outer edge of the sheet 34. On the surface of the ferrite sheet 35 is formed a U-shaped conductor pattern 35*a* and at one end thereof is formed a through-hole 35*b* perforating the sheet 35. On the surface of the ferrite sheet 36 is formed a J-shaped conductor pattern 36*a* extending at one end to the outer edge of the sheet 36 and at the other end of the conductive pattern 36*a* is formed a through hole 36*b*. The ferrite sheet 37 does not have a conductor pattern or through hole.

The ferrite sheets 31 through 37 thus constructed are sequentially laminated and baked so that the conductor patterns 31*a* and 32*a* are electrically connected through the through hole 32*b*, and those 32*a* and 33*a*, through the through hole 33*b*. A primary coil is provided between one end of the conductor pattern 31*a* and one end of the conductor pattern 33*a*. The conductor patterns 34*a* and 35*a* are electrically connected through the through hole 35*b*, and those 35*a* and 36*a*, through the through hole 36*b*. A secondary coil is provided between one end of the conductor pattern 34*a* and one end of the conductor pattern 36*a*.

Another example of the conventional laminated transformer is called the printing system one as shown in FIG. 6.

Such a laminated transformer at first is provided on a burnable ferrite sheet 45 with a first conductor pattern 46 of about a half turn of the winding (FIG. 6*a*). Next, a second ferrite layer 47 is printed on the first conductor pattern in a manner in which one end portion of the first conductor pattern 46 remains exposed (FIG.6*b*). And, on the second ferrite layer 47, a second conductor pattern 48 is formed of about a half turn of the winding and is connected to one end of the first conductor pattern 46 (FIG. 6*c*). Such ferrite layers and conductor patterns are formed foregoing order and are baked to form an integral laminated transformer.

In the through hole system laminated transformer 30, the conductor patterns 31*a* and 32*a* constituting the primary coil are vertically opposite each other with the ferrite sheet 32 disposed therebetween, while patterns 32*a* and 33*a* are vertically opposite each other with the ferrite sheet 33 disposed therebetween. Similarly, the conductor patterns 34*a* and 35*a* constituting the secondary coil are vertically opposite to each other with the ferrite sheet 35 disposed therebetween while patterns 35*a* and 36*a* are similarly disposed with the ferrite sheet 36 therebetween. Hence, capacitors are constituted between the conductor patterns 31*a* and 32*a*, 32*a* and 33*a*, 34*a* and 35*a*, and 35*a* and 36*a*, thereby facilitating an increase in the self distributed capacity which promotes self-resonance, whereby the laminated transformer having such construction has not been suitable for use in a high frequency circuit. When the through hole 32*b* shifts from the conductor pattern 31*a*, or the through hole 33*b* shifts from the conductor pattern 32*a*, or the through hole 35*b* shifts from the conductor pattern 34*a*, or the through hole 36*b* shifts from the conductor pattern 35*a* during the lamination of ferrite sheets 31 through 37, the continuous winding cannot be formed so as to occasionally cause a problem such as disconnection, thereby lowering the reliability.

On the other hand, the laminated transformer of the printing system, similar to the through hole system, has the capacitor defined between the respective conductor patterns, thereby being defective in that this laminated transformer is not suitable for use in a high frequency circuit.

The manufacture of the through hole system laminated transformer requires much time to form the through holes and to connect the ferrite sheets through the through holes, while, the manufacture of the printing system requires much time to superpose the ferrite layers and conductor patterns. Hence, the laminated transformers of both the aforesaid systems involve a problem in that their manufacturing processes are complicated and require much time.

SUMMARY OF THE INVENTION

A first object of the invention is to provide a laminated transformer which causes no self-resonance even when used in a high frequency band.

A second object of the invention is to provide a laminated transformer the manufacture of which is free from problems.

A third object of the invention is to provide a laminated transformer that is easy to manufacture and is high in reliability in comparison with the conventional laminated transformer of the through hole system or the printing system.

A fourth object of the invention is to provide a laminated transformer which can obtain an optional characteristic impedance with an appropriate design of the width of each conductor pattern and the intervals between the respective conductor patterns.

These and other objects of the invention will be seen by reference to the description, taken in connection with the accompanying drawings.

DETAILED DESCRIPTION OF THE PREFERRED EMBODIMENT

Figure 1:
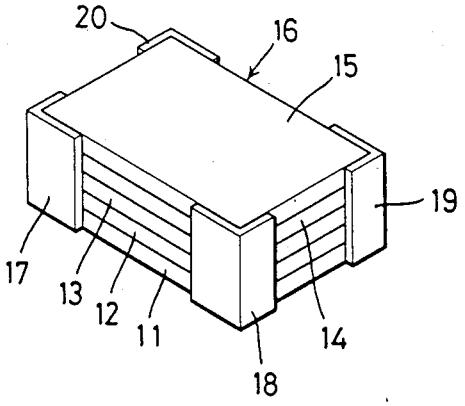
FIG. 1 is a perspective view of a laminated transformer of the invention.
Figure 2:
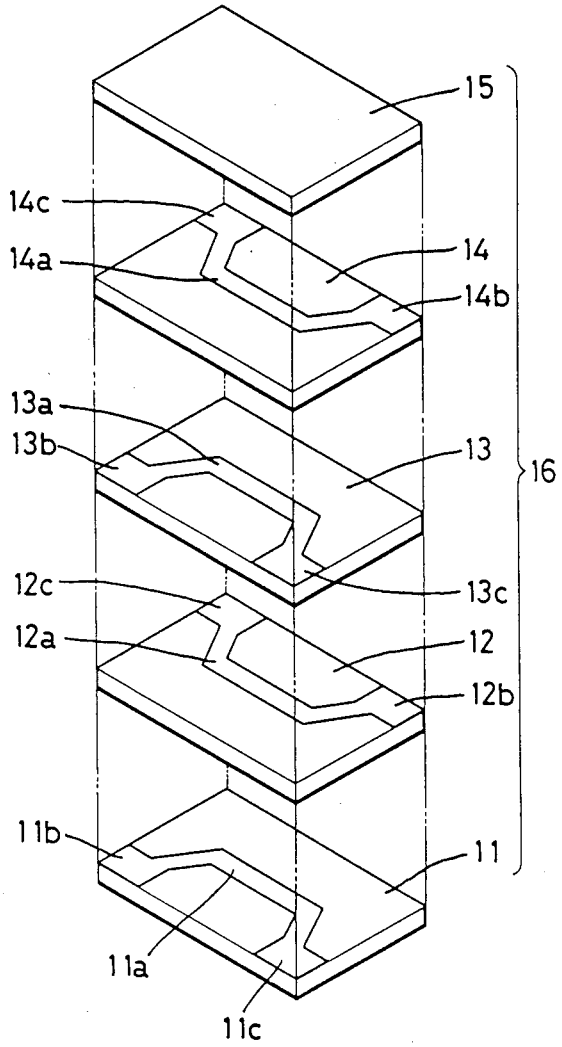
FIG. 2 is a perspective exploded view of the laminated transformer in FIG. 1, which comprises ferrite sheets on which linear conductor patterns are formed.

The laminated transformer of the invention, as shown in FIGS. 1 and 2, comprises a laminated sintered body 16 formed of a plurality (five in the drawings) of ferrite sheets 11 through 15 and external electrodes 17 through 20 provided an the sintered body 16.

The respective ferrite sheets 11 through 15 are rectangular and equal in size and have conductor patterns formed on the surface thereof as follows.

A linear conductor pattern 11*a* used for the primary is formed at the central portion of the surface of the ferrite sheet 11 and lead-out electrodes 11*b* and 11*c* connected to both ends of the conductor pattern 11*a* are formed at two corners of the sheet 11.

At the central portion of the surface of the ferrite sheet 12 is formed a linear conductor pattern 12*a* used for the secondary, and at two corners of the same and disposed opposite to the lead-out electrodes 11*b* and 11*c* of the ferrite sheet 11, are formed lead-out electrodes 12*b* and 12*c*, respectively.

The ferrite sheet 13 is the same as the ferrite sheet 11, and is provided with conductor pattern 13*a* used for the primary and two lead-out electrodes 13*b* and 13*c*.

The ferrite sheet 14 is the same as the ferrite sheet 12 and is provided with conductor pattern 14*a* used for the secondary and two lead-out electrodes 14*b* and 14*c*. The ferrite sheet 15 has no conductor pattern on the surface thereof. The ferrite sheets 11 through 15 thus constructed are laminated in the foregoing order and baked to form the laminated sintered body 16.

Figure 3:
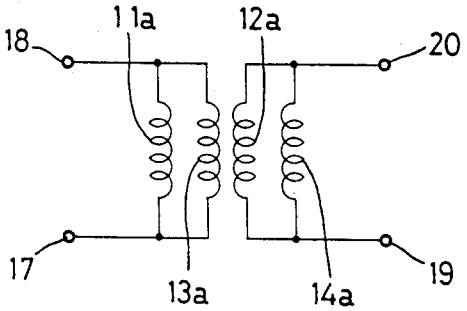
FIG. 3 is an equivalent circuit diagram of the laminated transformer shown in FIG. 1.

Referring to FIG. 1, reference numerals 17 and 18 designate the primary external electrodes, and 19 and 20 designate the secondary external electrodes, the electrodes 17 through 20 being formed at four corners of the laminated sintered body 16 by baking silver paste or the like thereon. The primary external electrode 17 is electrically connected with the lead-out electrodes 11*b* and 13*b*, the primary external electrode 18 with the lead-out electrodes 11*c* and 13*c*, the secondary external electrode 19 with the lead-out electrodes 12*b* and 14*b*, and the secondary external electrode 20 with the lead out electrodes 12*c* and 14*c*, respectively. As a result, an equivalent circuit of the laminated transformer is as shown in FIG. 3, in which the conductor patterns 11*a* and 13*a* are connected in parallel to each other for the primary and conductor patterns 12*a* and 14*a* are connected in parallel to each other for the secondary.

Thus, the laminated transformer of the invention comprises a plurality of ferrite sheets each having a conductor pattern formed on the surface thereof and laminated and baked to form the laminated sintered body, and the external electrodes formed at four corners of the sintered body, thereby facilitating ease in manufacture and high reliability in comparison with the conventional laminated transformer of the through hole system or the printing system.

Also, the conductor patterns used for the primary and the secondary have no coil and no self-distributed capacity, thereby not being subject to self-resonance even when used in the high frequency band.

In the embodiment of the laminated transformer of the invention, the ferrite sheets 11 to 14 have four conductor patterns. However, the present invention is not limited to having such a number, but may include any in number of patterns corresponding to a desired current capacity or inductance of the laminated transformer.

Figure 4:
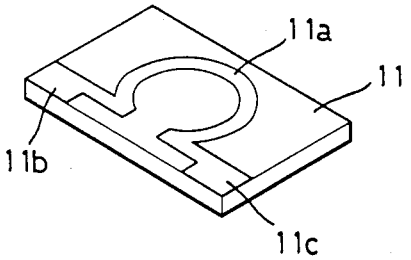
FIG. 4 is a perspective view of a ferrite sheet on which a conductor pattern having a circular arc shape is formed.
Figure 5:
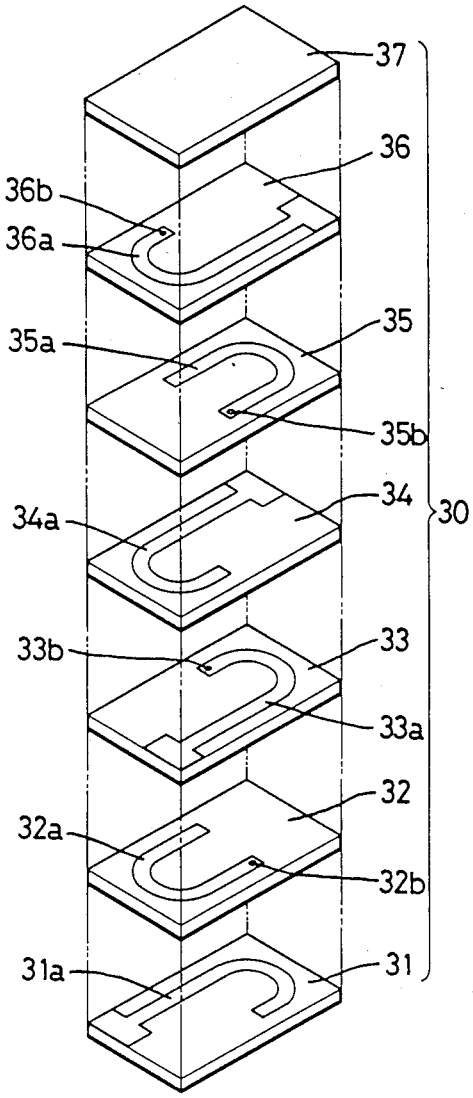
FIG.5 PRIOR ART
FIG. 5 is a perspective view of the conventional laminated transformer of a through hole system.
Figure 6:
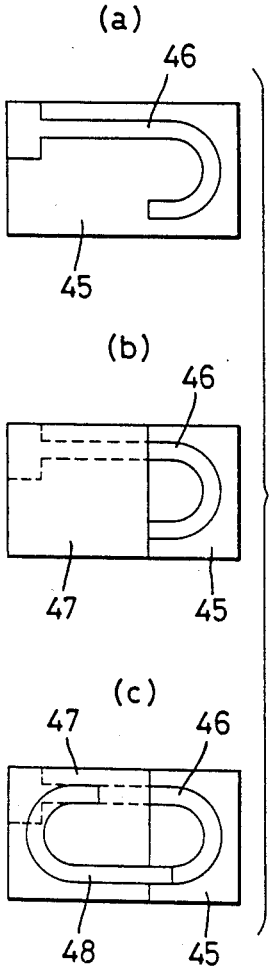
FIG.6 PRIOR ART
FIG. 6 is an illustration showing the manufacturing process of the conventional printing system laminated transformer.

Also, the configuration of the conductor patterns 11*a* through 14*a* on the ferrite sheets 11 through 14 is optional, and may be a circular arc as shown in FIG. 4, and intermediate taps may alternatively be provided at the primary and the secondary.

Furthermore, when the laminated transformer is used as a wide-band transformer, such as a balun transformer, the width and interval between the conductor patterns can be changed, thereby enabling optional characteristic impedance to be obtained.

Although several embodiments have been described, they are merely exemplary of the invention and not to be constructed as limiting, the invention being defined solely by the appended claims.

What is claimed is:

1. A laminated transformer comprising:

a laminated sintered body comprising a plurality of ferrite sheets, each of said ferrite sheets having end faces, and a conductor pattern thereon having each end extending to different portions of said end faces, the conductor patterns of some of said plurality of ferrite sheets serving as the primary of the transformer and the conductor patterns of the remainder of said plurality of ferrite sheets serving as the secondary of the transformer; and a pair of primary electrodes connecting the conductor patterns serving as the primary of the transformer in parallel, and a pair of secondary electrodes connecting the conductor patterns serving as the secondary of the transformer in parallel, said pair of primary electrodes electrically connected to ends of only the conductor patterns serving as the primary of the transformer at first and second locations from and to which the conductor patterns serving as the primary of the transformer extend, respectively, and said pair of secondary electrodes electrically connected to ends of only the conductor patterns serving as the secondary of the transformer at third and fourth locations from and to which the conductor patterns serving as the secondary of the transformer extend, respectively.

2. A laminated transformer as claimed in claim 1, wherein said some of said plurality of ferrite sheets and said remainder of said ferrite sheets are alternately disposed in said laminated sintered body.

3. A laminated transformer as claimed in claim 1, wherein each of said ferrite sheets is rectangular, and each of said conductor patterns extending thereon comprises a linear portion and two lead-out electrode portions each extending from a respective corner of the ferrite sheet to a respective end of said linear portion.

4. A laminated transformer as claimed in claim 1, wherein each of said ferrite sheets is rectangular, and each of said conductor portions extending thereon comprises an arcuate portion and two lead-out electrode portions each extending from a respective corner of the ferrite sheet to a resepective end of said arcuate portion.

* * * * *